US006715484B2

(12) United States Patent
Khosropour et al.

(10) Patent No.: US 6,715,484 B2
(45) Date of Patent: Apr. 6, 2004

(54) VENT HOOD FOR A KITCHEN STOVE

(75) Inventors: M. Michael Khosropour, Newton, IA (US); John P. Trickel, Grimes, IA (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/164,731

(22) Filed: Jun. 6, 2002

(65) Prior Publication Data

US 2003/0226559 A1 Dec. 11, 2003

(51) Int. Cl.[7] ..... F24C 15/20
(52) U.S. Cl. ..... 126/299 R; 126/299 D
(58) Field of Search ..... 126/299 R, 299 D; 55/DIG. 36; 454/49, 66

(56) References Cited

U.S. PATENT DOCUMENTS

| | | | | |
|---|---|---|---|---|
| 3,233,606 A | | 2/1966 | Turner, et al. | |
| 4,617,909 A | * | 10/1986 | Molitor | 126/299 R |
| 5,716,268 A | | 2/1998 | Strongin et al. | |
| 5,824,126 A | * | 10/1998 | Chen | 55/501 |
| 5,979,436 A | | 11/1999 | Chiang et al. | |
| 6,044,838 A | | 4/2000 | Deng | |

FOREIGN PATENT DOCUMENTS

| | | | |
|---|---|---|---|
| EP | 0304533 | * | 1/1989 |
| FR | 74 25636 | | 7/1974 |
| GB | 1349 199 | | 4/1971 |
| JP | 55028468 | * | 2/1980 |

* cited by examiner

*Primary Examiner*—Alfred Basichas
(74) *Attorney, Agent, or Firm*—McKee, Voorhees & Sease, P.L.C.

(57) ABSTRACT

A vent hood is provided for a stove having a plurality of burners. The vent hood includes a housing with a plurality of slots extending substantially around the perimeter of the housing through which cooking vapors pass. The hood includes a plurality of chambers to balance the air flow through the hood. An exhaust duct extends from the housing to an exhaust fan such that air is drawn upwardly through the slots, into the housing, and out the exhaust duct. The air is passed through an air filter for removal of odors and grease particles before being discharged back into the ambient kitchen air.

33 Claims, 8 Drawing Sheets

VENT HOOD FOR A KITCHEN STOVE

BACKGROUND OF THE INVENTION

Kitchen vent or exhaust systems are commonly used to remove steam, odors, and other airborne vapors resulting from cooking on stoves. The exhaust systems often times include grease filters to capture grease carried by the airborne vapors. Generally there are two types of exhaust systems. An up draft system utilizes a hood covering a portion or all of the stove burners to capture the rising air. The hood is attached to the wall, or in the case of a kitchen island, is suspended from the ceiling. Conventional vent hoods typically are cone shaped and include a centrally positioned fan which provides a centralized suction to draw air into the hood. However, such a centralized exhaust fails to capture much of the cooking vapors, which then escape into the ambient kitchen air carrying grease and odors. If a grease filter is not provided, the grease collects on the hood structure and eventually may drip back down onto the stove.

A second type of exhaust system is a down draft system, which is typically built into the stove or adjacent countertop to draw the air laterally and then downwardly into an exhaust duct. Since heated air rises, such down draft systems are very inefficient.

Accordingly, a primary objective of the present invention is the provision of an improved vent hood for exhausting cooking air.

Another objective of the present invention is the provision of an improved up draft exhaust system for stoves.

A further objective of the present invention is the provision of a vent hood which can be used on a kitchen island.

Another objective of the present invention is the provision of a kitchen vent hood with improved efficiencies.

Still another objective of the present invention is the provision of a kitchen vent hood which extends over all of the stove burners to minimize or eliminate the escape of cooking vapors into the ambient kitchen air.

A further objective of the present invention is the provision of a kitchen vent hood which creates an up draft curtain around the stove burners to capture substantially all of the cooking vapors.

These and other objectives will be apparent from the following description of the invention.

SUMMARY OF THE INVENTION

An improved kitchen vent hood is provided, and is particularly suitable in providing updraft exhaust of cooking vapors on an island stove or cooktop. The vent hood has a plurality of air inlet slots extending around its lower perimeter to draw air into the hood. The hood extends over all of the stove burners so as to provide an exhaust curtain extending 360° around the stove burners to substantially prevent cooking vapors from escaping into the ambient kitchen air. The hood includes a plurality of internal vanes or baffles which define compartments, each associated with at least one air inlet slot, which balance the air flow to an exhaust duct mounted at the rear of the vent hood. The slots have flared edges so as to minimize air flow noise, turbulence and pressure losses. The area of the air inlet slots is approximately equal to the cross sectional area of the exhaust duct. A lip extends downwardly around the perimeter of the housing to substantially contain the flow of air upwardly from the stove to an area within the hood for passage through the slots.

DETAILED DESCRIPTION OF THE DRAWINGS

Figure 1:
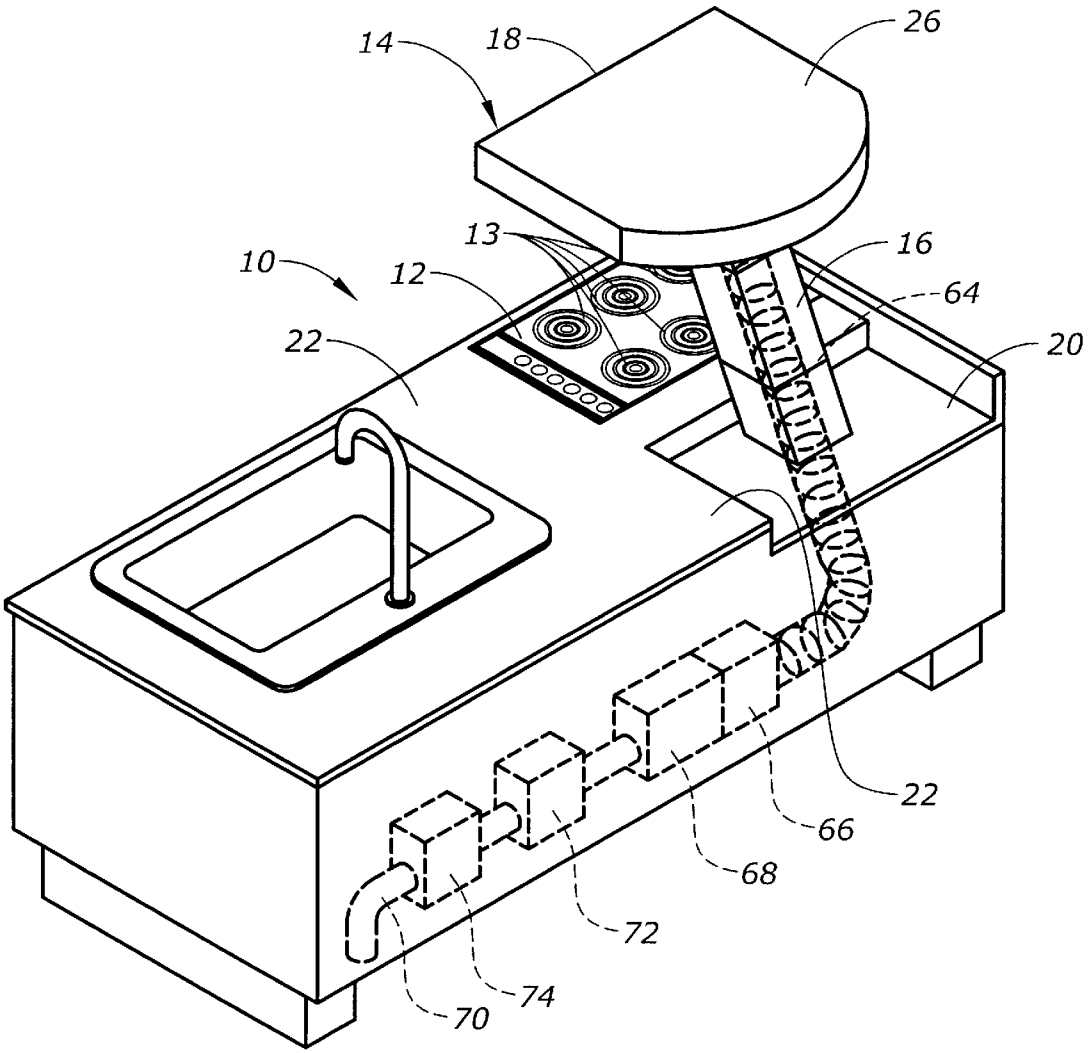
FIG. 1 is a perspective view of the kitchen exhaust system of the present invention as used on an island having a stove.
Figure 2:
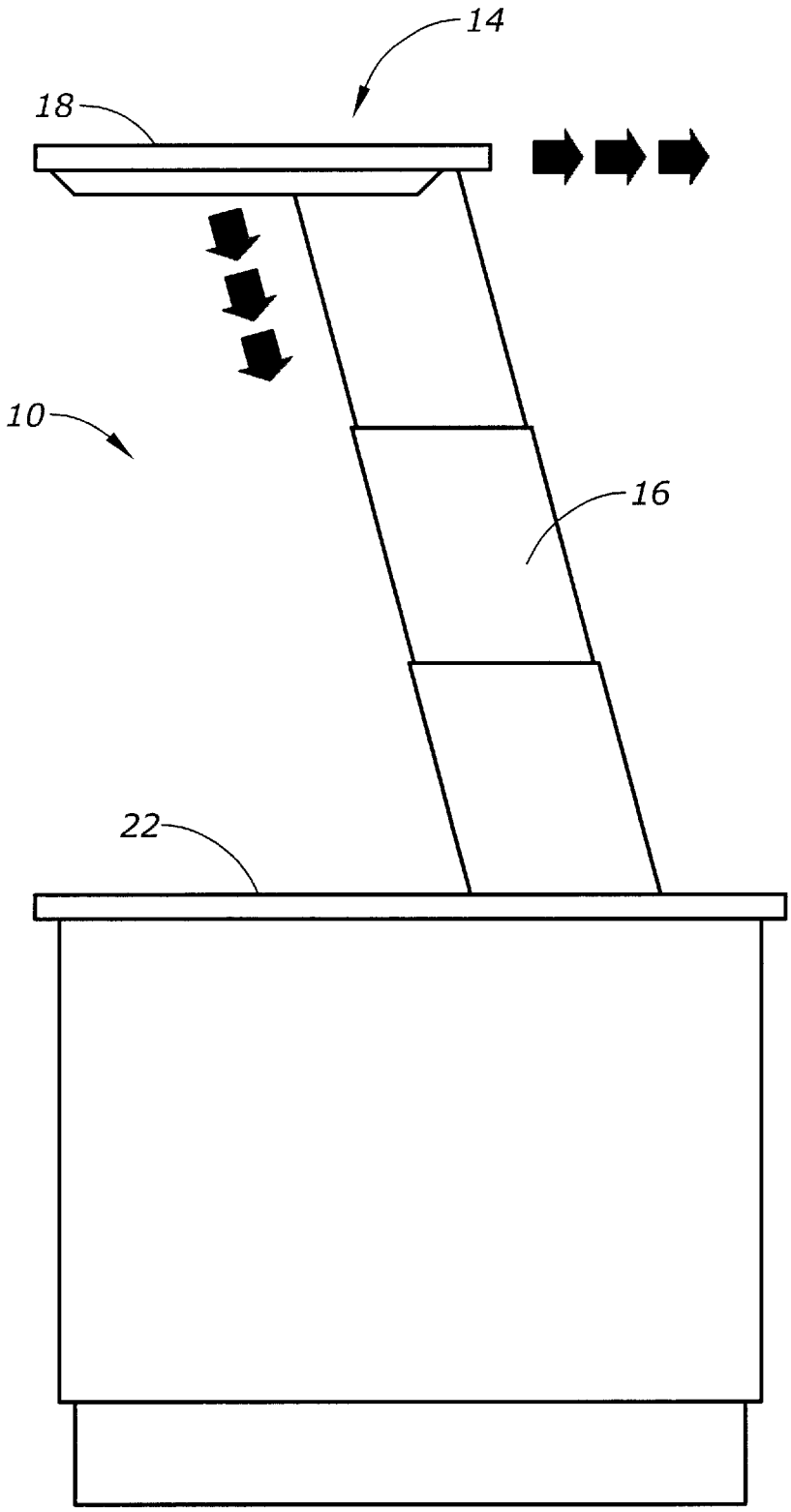
FIG. 2 is a side elevation view of the kitchen exhaust system of the present invention, with the hood in an extended position.

A kitchen island is generally designated by the reference numeral 10 in the drawings. The island includes a stove top or cooking surface 12 with a plurality of burners 13 and a vent hood assembly 14. The vent hood assembly 14 includes a telescoping lift column 16 with a retractable and extendable vent hood 18 of the present invention. As seen in FIG. 1, the vent hood assembly 14 extends upwardly in the operative or use position from a recessed area 20 in the rear portion of the island 10. In the non-use or storage position, the vent hood assembly 14 resides within the recess 20. Preferably, when the vent hood assembly 14 is lowered and retracted into the recess 20, the top of the vent hood 18 is slightly above the countertop 22 of the island 10 so as to discourage the setting of an object on the edge of the vent hood 18 where the object could fall off or spill when the vent hood assembly 14 is raised. Alternatively, the top of the vent hood 18 can be flush with the countertop 22 when the vent hood assembly 14 is in the storage position. The top surface of the vent hood 18 may include a slightly raised drip edge to prevent liquids spilled on the hood 18 from falling into the recess 20. As seen in FIGS. 1 and 2, the column 16 preferably extends at a non-perpendicular angle relative to the cooking surface 12. The angle is in the range of 10°–20° from vertical, with the preferred angle of 15°.

Figure 3:
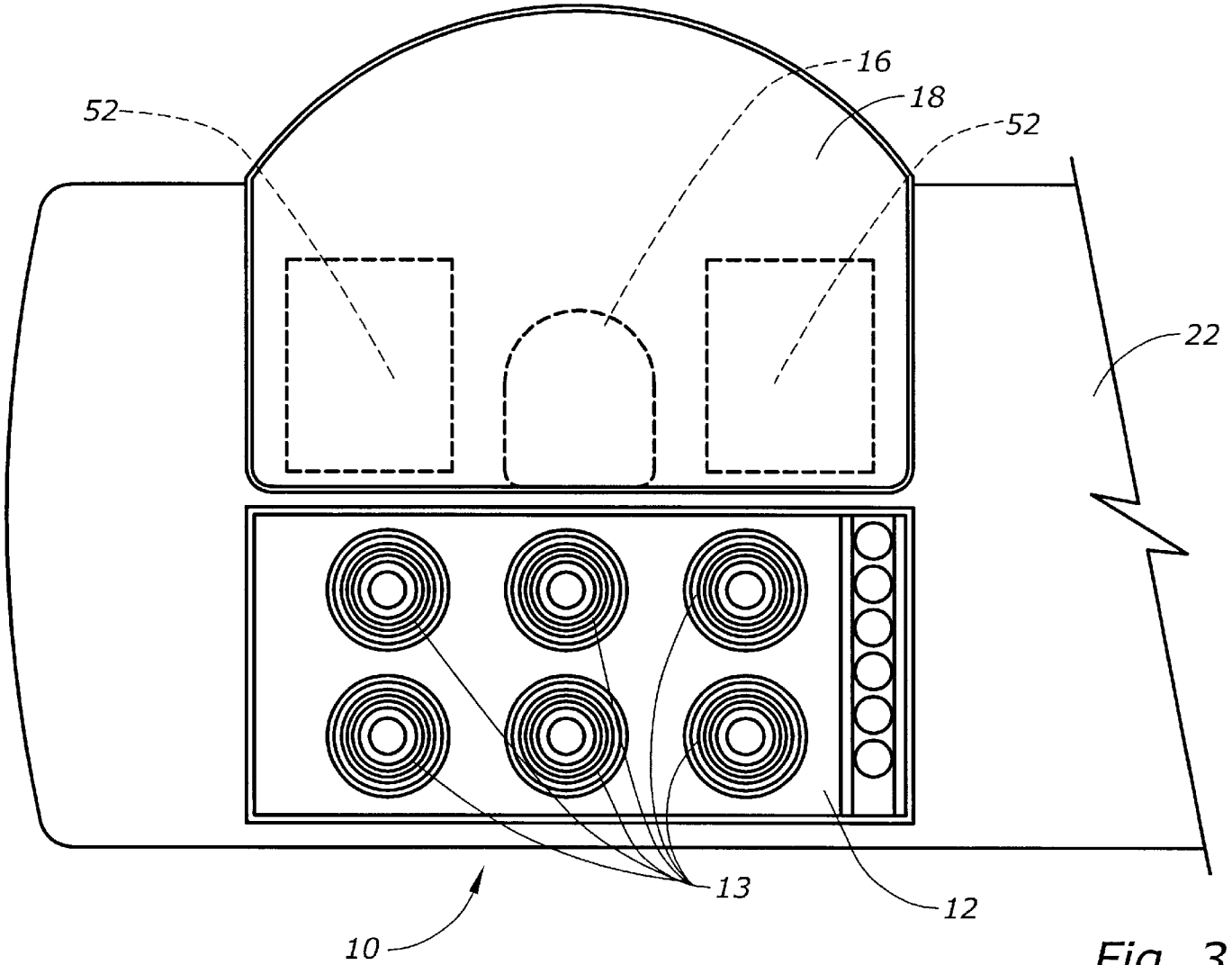
FIG. 3 is a top plan view of the kitchen exhaust system of the present invention with the hood in a retracted position.

The vent hood 18 is mounted on the column 16 so as to be horizontally moveable between a retracted position, shown in FIG. 3, and an extended position, shown in FIGS. 1 and 2. The angular orientation of the column 16 allows the vent hood 18 to be positioned fully over the cooking surface 12 with less forward movement, as compared to a vertical column. While it is understood that the column 16 may be oriented vertically, such a vertical orientation would require a greater extension of the vent hood 18 for positioning over the cooking surface 12.

The vent hood 18 generally includes a housing 24 defined by a top wall or cover 26, a bottom wall 28, a front wall 30, a back wall 32, and opposite side walls 34. The front wall 30, back wall 32 and side walls 34 define a perimeter edge for the vent hood 18. The bottom wall 28 includes central area 57 in which the mechanical structure for moving the vent hood 18 forwardly and rearwardly with respect to the lift column 16 is mounted. This movement structure is described in applicant's co-pending application Ser. No. 10/163,558, entitled IMPROVED KITCHEN VENT HOOD, filed Jun. 6, 2002, and is incorporated herein by reference. The structure for raising and lowering the telescoping column 16 is also disclosed in the same co-pending application, and is incorporated herein by reference.

The bottom portion 28 of the housing 24 is defined by a rear plate 36 having a curved rearward edge, and a U-shaped central plate 38. The rear plate 36 and central plate 38 have cut out portions to define a central opening 40.

The rear plate 36 includes a plurality of slots 42 which are a part of the exhaust system, as described below. The rear plate 36 also has a plurality of openings or holes 44 in which lights can be operatively mounted to illuminate the cooking surface 12.

Figure 8:
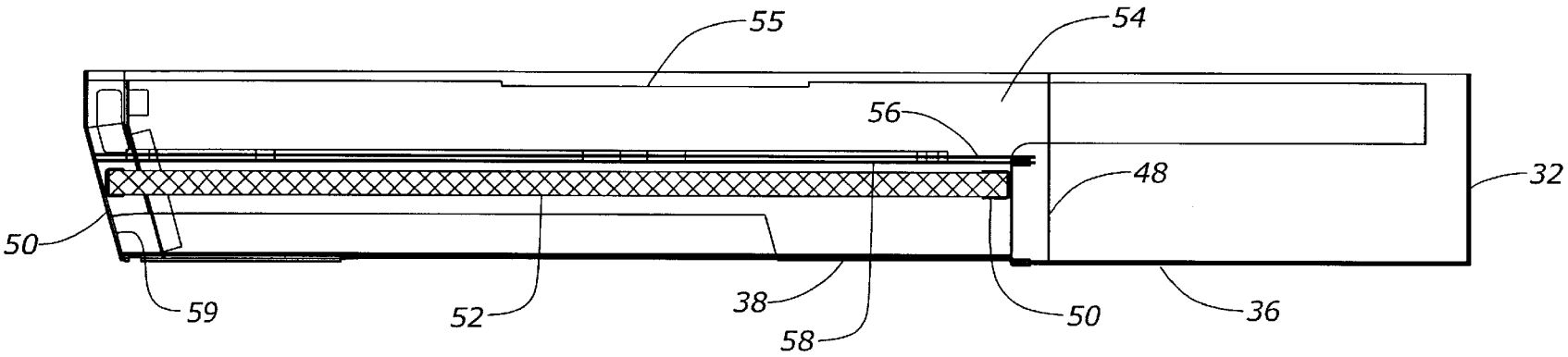
FIG. 8 is a sectional view taken along lines 8—8 of FIG. 7.

A pair of upright plates 48 extend upwardly and laterally at the front edge of the rear plate 36 on each side of the central opening 40. C-shaped clips 50 are provided on the front face of the plates 48 and on the rear face of the front wall 30, as best seen in FIG. 8, so as to support a grease filter 52 on each side of the central opening 40.

Figure 7:
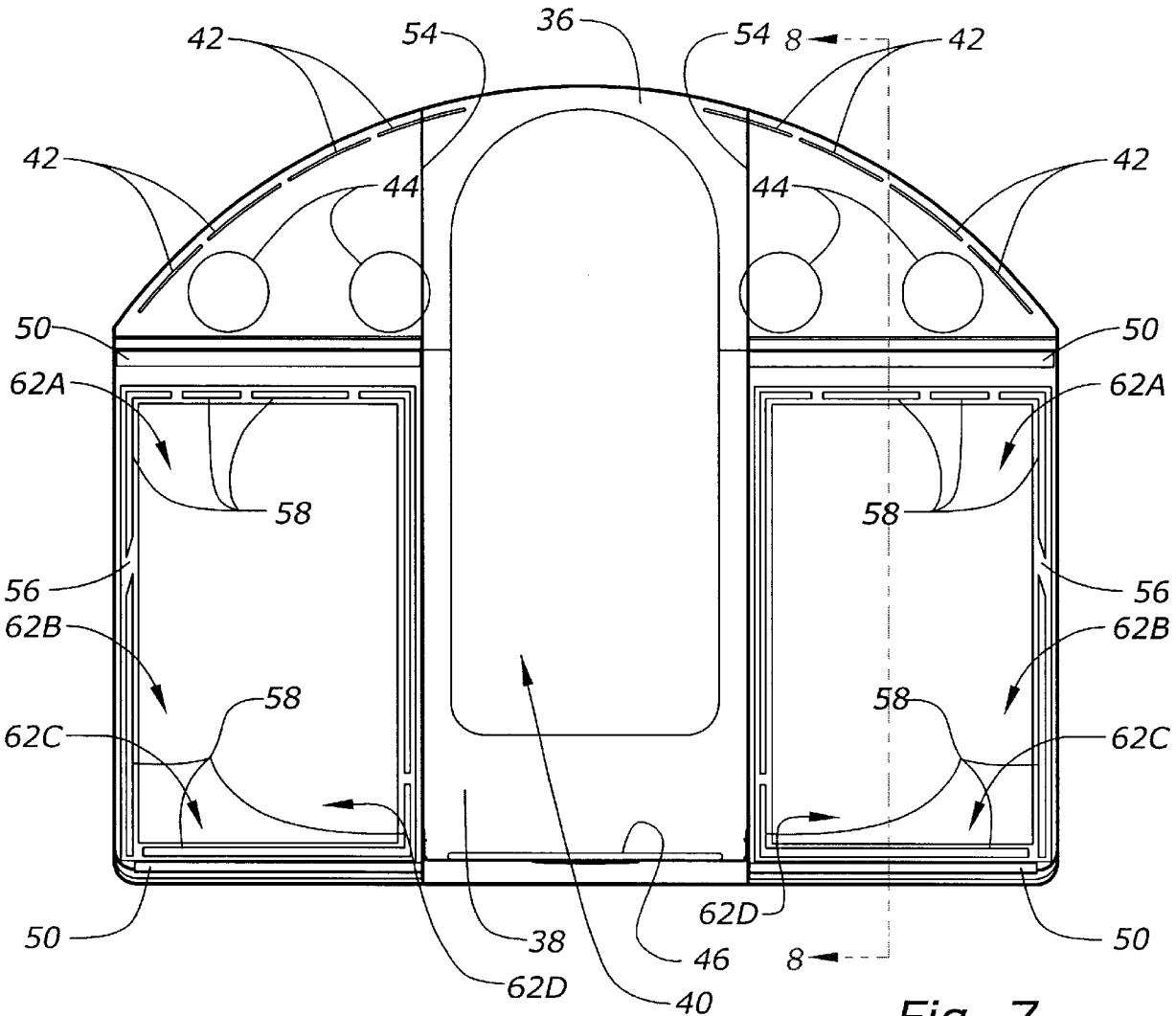
FIG. 7 is a bottom plan view of the vent hood as shown in FIG. 5.

A pair of longitudinally extending braces 54 extend between the front wall 30 and the back wall 32 on each side of the central opening 40. A pair of rectangular frames 56 extend between the respective side walls 34 and braces 54, and extend substantially from the front wall 30 to the front edge of the rear plate 36, as best seen in FIG. 7. A plurality of air inlet slots 58 extend through and around the frames 56. Thus, as can be seen in FIG. 7, the slots 42, 46 and 58 define air inlets extending substantially around the perimeter of the vent hood 18.

At least the front wall 30 and side walls 34 of the housing 24 extend downwardly to a level below the frames 56 and center plate 38, to define a lip 59 extending around the front and sides of the vent hood 18. The lip 59 helps contain the rising vapors within the perimeter of the vent hood 18 for passage through the slots 46, 58. Also, the slots 42, 46 and 58 define a negative pressure air-curtain extending around the cooking surface 12 so as to efficiently capture the airborne vapors generated by the cooking process.

Figure 4:
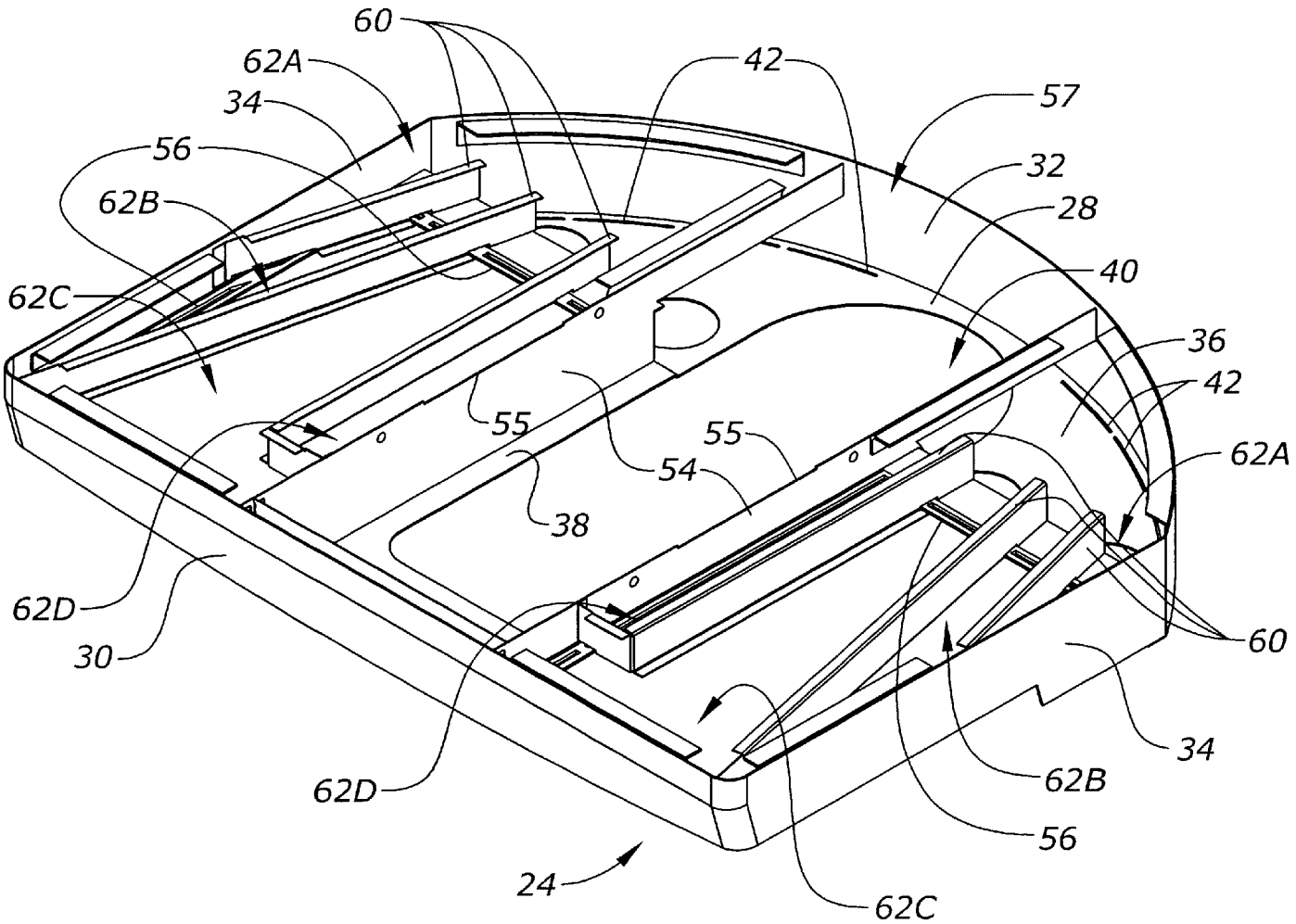
FIG. 4 is a top perspective view of the vent hood of the present invention with the grease filters and top cover removed for clarity.
Figure 5:
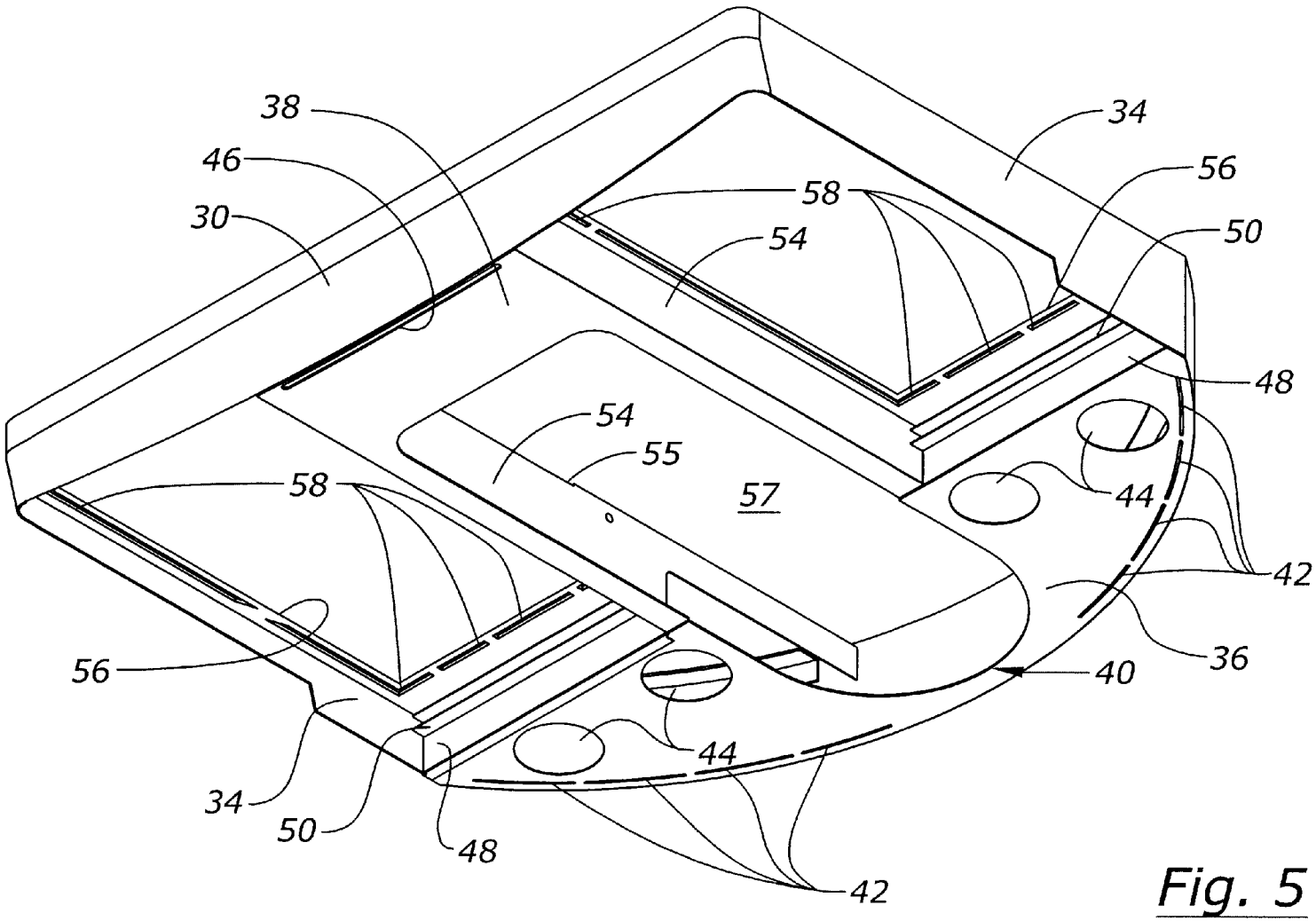
FIG. 5 is a bottom perspective view of the vent hood of the present invention with the grease filters and vanes removed for clarity.
Figure 6:
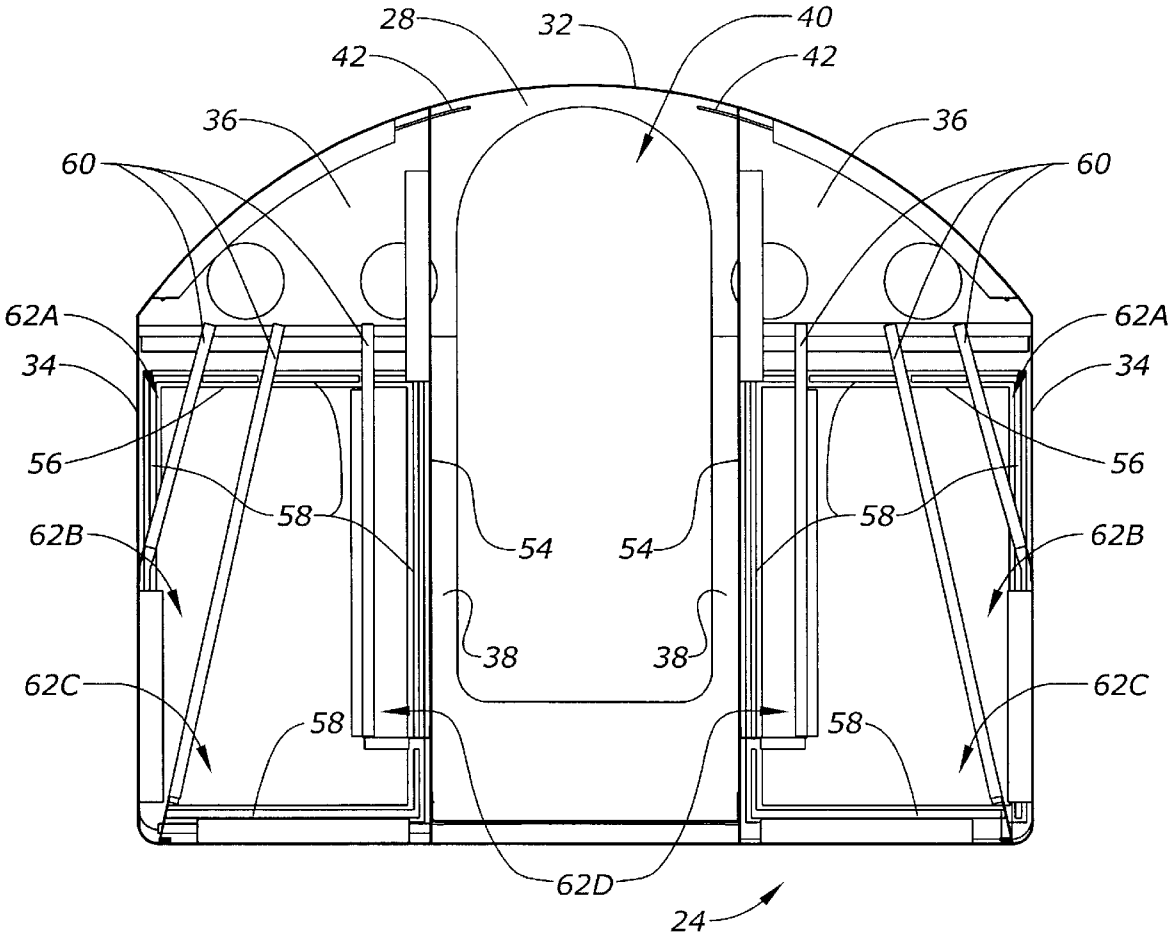
FIG. 6 is a top plan view of the vent hood as shown in FIG. 4.

As best seen in FIGS. 4 and 6, a plurality of vanes 60 are mounted within the housing 24 on each side of the central opening 40 so as to define separate or individual compartments or zones 62A, 62B, 62C, and 62D. Each compartment 62A–D is associated with one or more of the slots 46, 58. The rearward edges of each compartment 62A–D define outlets having different widths, which yields equal air flow velocities from the compartments 62A–D. The volume of each compartment 62A–D corresponds to the area of the associated slots 46, 58. Thus, the compartments 62A–D provide a balanced air flow to an exhaust duct 64 mounted at the rear of the vent hood 18. Preferably, the slots 42, 46 and 58 define an air inlet area which is substantially equal to the cross-sectional area of the exhaust duct 64. As further shown in FIG. 4, notches 55 provide air flow communication between central area 57 and compartments 62D.

All of the slots 42, 46 and 58 have rounded or flared edges, as opposed to square punched or sheared edges, so as to eliminate or minimize air flow noise and turbulence as the heated vapors pass through the slots. It is also understood that the slots do not necessarily have the same width. For example, the rear slots 42 are generally narrower than the side or front slots 46, 58, since the rear slots are closer to the exhaust duct 64.

Thus, the slots 42, 46, 58 capture different volumes of rising air with any pressure drop being equalized in the compartments 62A–D due to the arrangement of the vanes 60. The compartments 62A–D are independent from one another. The flared slots also reduce restrictions and increase air flow by reducing pressure and increasing volume.

A flexible exhaust duct 64 extends downwardly through the lift column 16 and is operatively connected to an air filter 66 and a fan 68 for removing odors from the air before being discharged back into the kitchen through a vent 70 within the island 10. A dehumidifier 72 and a heater 74 may also be provided in the exhaust system, as shown in FIG. 1. The air filtration system is more fully described in applicant's co-pending application Ser. No. 10/163,643 filed Jun. 6, 2002 and entitled KITCHEN AIR FILTRATION SYSTEM, which is incorporated herein by reference.

In operation, the lift column 16 of the vent hood assembly 14 is extended from the retracted storage position within the recess 20 of the island 10 to a desired height, and the vent hood 18 is extended forwardly from the retracted position shown in FIG. 3 to a desired position covering the front and/or rear burners 13. During cooking, the fan 68 is actuated to draw the cooking vapors through the grease filters 52, the slots 46 and 58, and the slots 42. Additionally, notches 55 provide an airflow path for evacuating air from central area 57 into compartments 62A–D and into exhaust duct 64. The air passing through the grease filters 52 and the slots 46 and 58 passes rearwardly through the compartments 62A–D and joins the air passing through the slots 42 for entry into the exhaust duct 64. The exhausted air is then drawn through the air filter 68 to remove odors and grease particles before being discharged through an opening 70 within the island 10 and back into the kitchen.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A vent hood for a stove having a plurality of burners, comprising:

a housing with a top wall, a bottom wall, and upstanding perimeter walls defining a front edge, a rear edge and opposite side edges;

a plurality of slots extending through the bottom wall and adjacent the perimeter of the housing;

an exhaust duct having a first end mounted adjacent the housing and having a second end operatively connected to an exhaust fan; and a plurality of vanes mounted in the housing to direct air from the slots to the exhaust duct, whereby air is drawn upwardly through the slots, into the housing and into the exhaust duct.

2. The vent hood of claim 1 further comprising at least one grease filter mounted in the housing.

3. The vent hood of claim 1 wherein the vanes define independent air flow compartments within the housing.

4. The vent hood of claim 3 wherein each compartment is associated with at least one slot.

5. The vent hood of claim 3 wherein the compartments have balanced air flow.

6. The vent hood of claim 3 wherein the compartments produce equal air flow velocity.

7. The vent hood of claim 3 wherein each compartment has an air flow outlet.

8. The vent hood of claim 7 wherein the air flow outlets are different in dimension for each of the compartments.

9. The vent hood of claim 1 wherein the slots define an air inlet area which is substantially equal to the cross-sectional area of the first end of the duct.

10. The vent hood of claim 1 wherein the exhaust duct is located adjacent the rear edge of the housing.

11. The vent hood of claim 1 wherein the slots have flared edges to minimize air flow noise and turbulence.

12. The vent hood of claim 1 wherein the slots extend substantially around the perimeter of the housing to create an upward air flow curtain extending 360° around the stove burners.

13. The vent hood of claim 1 wherein the housing includes a lip extending downwardly around the perimeter thereof to substantially contain the flow of air upwardly from the stove to an area within the hood for passage through the slots.

14. An exhaust system for an island stove having a plurality of burners, comprising:

a hood adapted to extend over all of the burners during cooking;

a plurality of air inlets adjacent the perimeter of the hood;

an exhaust duct mounted in the hood;

a fan operatively connected to the exhaust duct to draw air through the inlets into the hood; and a plurality of baffles mounted in the hood to direct air drawn into the inlets for removal through the duct by the fan.

15. The exhaust system of claim 14 wherein the hood has a perimeter and the air inlets are slots extending substantially 360° around the perimeter.

16. The exhaust system of claim 15 wherein the slots are flared to inhibit air flow noise and turbulence.

17. The exhaust system of claim 14 further comprising a grease filter mounted in the hood.

18. The exhaust system of claim 14 wherein the baffles creating a plurality of compartments within the housing, with each compartment having at least one air inlet associated therewith and each compartment directing air to the exhaust duct.

19. The exhaust system of claim 18 wherein each compartment has an outlet, with all outlets having different dimensions.

20. The exhaust system of claim 14 wherein the air inlets have a cumulative area substantially equal to a cross-sectional area of the air duct.

21. The exhaust system of claim 14 further comprising a lip extending around the hood to substantially inhibit flow of air outwardly away from the air inlets.

22. A method of venting airborne vapors generated by cooking on a kitchen stove having a plurality of burners, the method comprising:

positioning a vent hood over the burners being used for cooking, the hood having a plurality of air inlet slots;

drawing air and vapors upwardly through the slots and into the hood in a curtain pattern surrounding the cooking burners; and directing the vapors through separate compartments in the hood to an exhaust duct.

23. The Method of claim 22 further comprising drawing at least a portion of the vapors through a grease filter mounted in the hood.

24. The method of claim 22 further comprising directing the vapors rearwardly in the hood to the exhaust duct adjacent a near portion of the hood.

25. The method of claim 24 further comprising drawing in a volume of air through the slots substantially equal to a volume of air being exhausted through the duct.

26. The method of claim 22 further comprising balancing the air flow through the compartments.

27. The method of claim 22 further comprising generating substantially equal air flow velocities through the compartments.

28. The method of claim 22 further comprising containing the vapors substantially beneath the hood with a perimeter lip extending around the hood.

29. The method of claim 22 further comprising enhancing smooth air flow through the slots by rounding the edges of the slots.

30. The method of claim 22 further comprising filtering the air and vapors to clean the air.

31. The method of claim 30 further comprising discharging the filtered air back into the kitchen.

32. The method of claim 31 further comprising heating the filtered air before discharge back into the kitchen.

33. The method of claim 31 further comprising passing the filtered air through a dehumidifier before discharge back into the kitchen.

* * * * *